US007659527B1

(12) United States Patent
Seibert et al.

(10) Patent No.: US 7,659,527 B1
(45) Date of Patent: Feb. 9, 2010

(54) INFRARED MARKING DEVICE AND METHODS

(76) Inventors: Earl Seibert, 1560 Faul La., Milford, OH (US) 45150; Harley Sheppard, 9228 Morrow-Rossberg Rd., Pleasant Plain, OH (US) 45162

( * ) Notice: Subject to any disclaimer, the term of this patent is extended or adjusted under 35 U.S.C. 154(b) by 825 days.

(21) Appl. No.: 11/381,674

(22) Filed: May 4, 2006

(51) Int. Cl.
*G21G 4/00* (2006.01)

(52) U.S. Cl. ..... 250/493.1; 250/495.1; 250/336.1; 359/515; 359/516; 359/517; 359/518

(58) Field of Classification Search ..... None
See application file for complete search history.

(56) References Cited

U.S. PATENT DOCUMENTS

| | | | | |
|---|---|---|---|---|
| 1,899,286 | A | 2/1933 | Meagher | |
| 4,146,887 | A | 3/1979 | Magnante | |
| 5,560,491 | A | 10/1996 | Romaniuk et al. | |
| 5,825,280 | A | 10/1998 | Merendini et al. | |
| 5,850,172 | A | 12/1998 | Lenz et al. | |
| 6,051,840 | A | 4/2000 | Henderson | |
| 6,215,416 | B1 | 4/2001 | Henderson | |
| 6,616,128 | B2 | 9/2003 | Selzer | |
| 6,767,015 | B1 * | 7/2004 | Parsley | 273/348.1 |
| 2003/0102468 | A1 | 6/2003 | Selzer | |
| 2004/0065850 | A1 * | 4/2004 | Kane | 250/495.1 |
| 2004/0213982 | A1 * | 10/2004 | Touzov | 428/304.4 |
| 2007/0180937 | A1 * | 8/2007 | Thomson et al. | 73/865.9 |

OTHER PUBLICATIONS

Joel Bainerman, Israeli Researchers Combine IR Camera, Cell Phone, http://www.eetimes.com (Feb. 1, 2006) (1 page).

* cited by examiner

*Primary Examiner*—David A Vanore
*Assistant Examiner*—Andrew Smyth
(74) *Attorney, Agent, or Firm*—Wood, Herron & Evans, LLP

(57) ABSTRACT

Infrared marking devices and methods for marking an object, such as a door, inside a structure, such as a smoke-filled or burning structure. The infrared marking device comprises a ring-shaped, elasticized outer sleeve having a tubular sidewall and an amount of a self-heating material confined inside the tubular sidewall of the outer sleeve. The self-heating material emits infrared radiation when activated to initiate an exothermic chemical reaction. The infrared radiation is visible in a thermal imaging camera. The method comprises activating a self-heating material confined inside a marking device to initiate an exothermic reaction that emits infrared radiation and applying the marking device to an object inside the structure.

20 Claims, 5 Drawing Sheets

INFRARED MARKING DEVICE AND METHODS

FIELD OF THE INVENTION

The invention relates generally to infrared marking devices and methods and, in particular, to infrared marking devices visible through thermal imaging cameras and methods of using the infrared marking devices.

BACKGROUND OF THE INVENTION

When firefighters and other emergency personnel arrive at a smoke-filled or burning building or structure, a search and rescue operation is conducted in which each room of the burning structure is systematically searched for persons trapped by the structure fire or otherwise unable to escape from the burning structure. Typically, the firefighters don protective survival gear (e.g., self contained breathing apparatus) and search in teams by following the structural walls. Dense smoke and darkness severely limit the visibility inside the burning structure and hamper firefighter search and rescue operations, sometimes at the risk of the firefighter's safety.

After each room in the burning structure is searched and before searching the next room, a conventional type of marker may be used to mark the entrance leading into the searched room. These markers indicate to subsequent firefighters that the room has been previously searched during the search and rescue operation. Marking searched rooms expedites the search and rescue operation as rooms are not needlessly searched multiple times by different firefighters or by even the same team of firefighters disoriented by the dense smoke and darkness. Searched rooms may be indicated by, for example, placing a chair in the doorway or by marking the door with a crayon or chalk mark.

Another conventional type of marker may be applied to a door at the entrance leading into the room. These conventional markers may rely on a visible indicator, such as a visible strobe light, a reflector, or a colored object, to alert the firefighters that a particular room in the burning structure has been searched. However, smoke has a large component of micron-sized carbon soot particles in it, making it very absorbing at the visible-light wavelengths. Hence, visual indicators are inadequate under conditions of dense smoke and darkness in which vision is obscured. Conventional markers may also rely on an audible signal, such as sound emitted from a speaker, to alert the firefighters that a particular room in the burning structure has been searched. However, the firefighter's ability to discern markers emitting audible signals may be indistinguishable from other environmental noises or may be muffled and muted by the survival gear worn by the firefighter. Verbal communications to communicate searched rooms is also obscured by the environmental noises and the firefighter's survival gear.

Thermal imaging cameras ("TICs") permit firefighters to penetrate heavy smoke and overcome the handicap of darkness to visualize heat sources in situations of limited visibility during search and rescue operations. Typically, a fireman carries a portable, hand-held thermal imaging camera into a burning structure and relies on thermal patterns visible in the camera display that indicate the presence of a person, a hot spot which may be the source of the fire, or some other thermal characteristic or heat emitting object of interest. The thermal imaging camera converts infrared radiation emitted by the heat source, which is not visible to the human eye, into a visible image viewable on the camera's display. The thermal imaging camera detects the frequency or wavelength of the radiation, which is related to a specific temperature. The wavelength of the emitted infrared radiation increases as the temperature of the heat source increases. On the display of the thermal imaging camera, heat sources are displayed with a color or gray scale in which the displayed brightness increases with temperature. The detection threshold of the electronics in the thermal imaging camera is typically adjusted so that low temperature objects are not visible in the displayed image. This improves the image contrast between heat sources of interest and background objects.

Conventional markers that rely on the emission of visible light or sensing by the unaided human eye are not imaged by the thermal imaging camera as visible wavelengths are outside of the infrared band of the electromagnetic spectrum. Moreover, the temperature of objects emitting visible light lack a sufficient heat signature to be plainly visible in a thermal imaging camera. In addition, the range of the visible light emitted from the object and the ability to see a visual indicator is limited by an inability to penetrate the dense smoke. Conventional markers that rely on reflection are ineffective in the absence of an infrared radiation source for reflection. Thermal imaging cameras are passive devices in that they do not carry such infrared radiation sources. Even if an infrared source were married with a thermal imaging camera, the high directionality of the infrared light beam projected from the camera would dramatically restrict the firefighter's ability to successfully reflect infrared radiation from the reflector. Colored objects cannot be visualized using a thermal imaging camera because of the invisibility of light in the visible band of the electromagnetic spectrum to the camera's imaging system. If firefighters are compelled by the nature of the structure fire to crawl during the search and rescue operation, conventional room markers may be difficult to distinguish visually. Obviously, sound emitting markers cannot be imaged by the thermal imaging camera.

What is needed, therefore, is a marker for a room door that may operate in conjunction with a thermal imaging camera during search and rescue operations conducted by firefighters inside a smoke-filled or burning structure that overcomes these and other deficiencies of conventional markers.

SUMMARY OF THE INVENTION

In accordance with an embodiment of the present invention, an infrared marking device comprises a ring-shaped, elasticized outer sleeve having a tubular sidewall and an amount of a self-heating material confined inside the tubular sidewall of the outer sleeve. The self-heating material emits infrared radiation when activated to initiate an exothermic chemical reaction. The infrared marking device, which may be used as a marker for a room door during search and rescue operations conducted by firefighters inside a smoke-filled or burning structure, has a heat signature of infrared radiation that is imageable in a thermal imaging camera.

In certain embodiments, the sidewall of the outer sleeve is permeable to oxygen and the self-heating material reacts exothermally when exposed to the oxygen permeating through the sidewall. In other embodiments, the infrared marking device may further comprise a ring-shaped elastic band positioned inside the outer sleeve and extending circumferentially about the outer sleeve. The elastic band operates to elasticize the outer sleeve.

In accordance with an embodiment of the present invention, a method is provided for marking an object, such as a door, inside a structure, such as a smoke-filled or burning structure. The method comprises activating a self-heating material confined inside a marking device to initiate an exothermic reaction that emits infrared radiation and applying the marking device to the object inside the structure.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION

Figure 1:
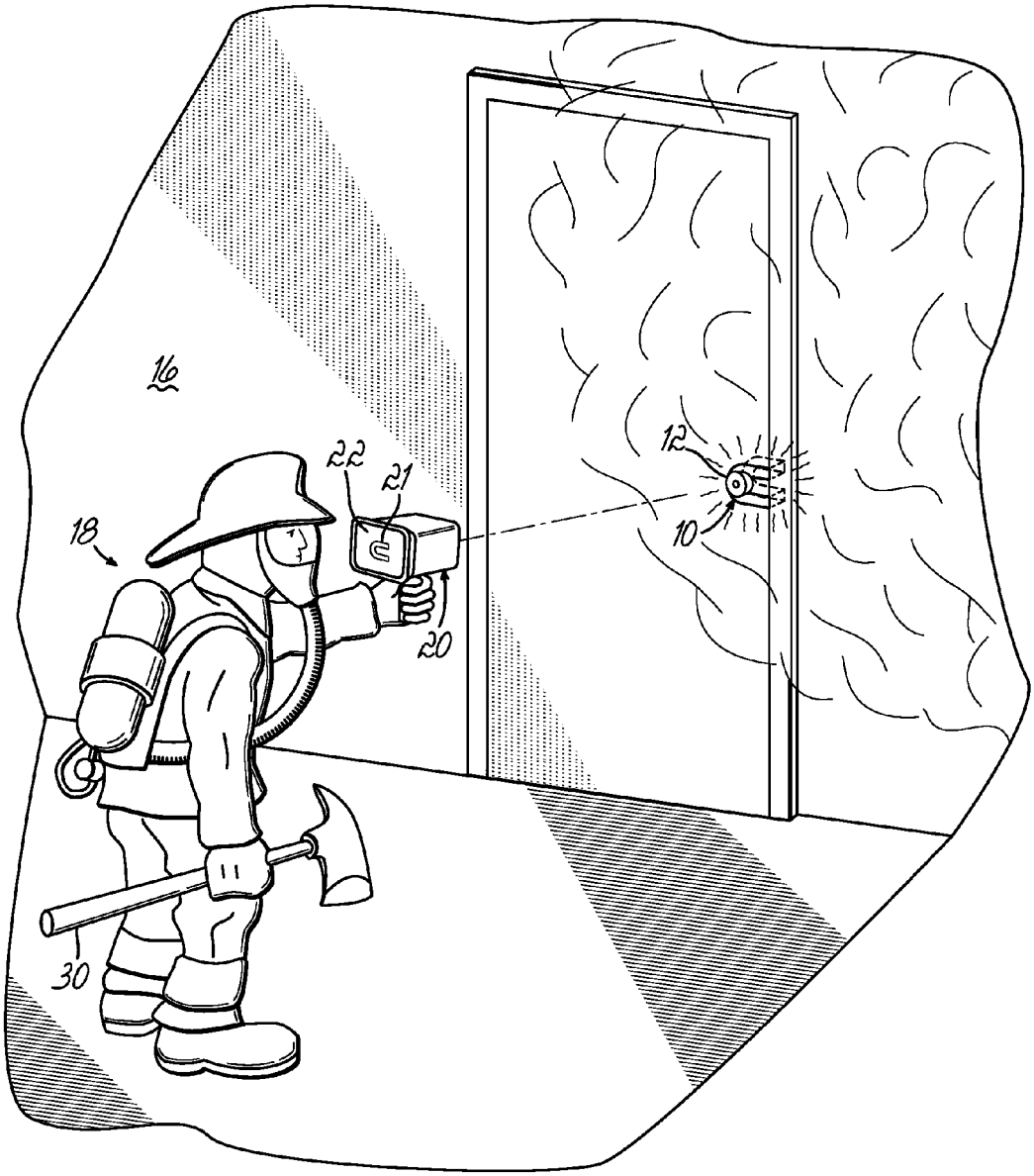
FIG. 1 is a perspective view of an infrared marker deployed on the knobs of a door in accordance with an embodiment of the present invention.

The present invention is generally directed to infrared marking devices visible inside a smoke-filled or burning structure to firefighters using a thermal imaging camera. The infrared marker preferably contains an oxygen-activated exothermic composition that emits heat when activated. The infrared marking devices, when activated and attached to the knobs of a door, are used to subsequently signal firefighters that a room has been searched and cleared. The infrared marking devices may also be attached to a tool handle for advantageously locating a dropped tool. The present invention will now be described in greater detail by referring to the drawings that accompany the present application.

With reference to FIG. 1 and in accordance with an embodiment of the present invention, an infrared marking device or infrared marker 10 is deployed by attachment to door levers or knobs 12 and 13 (FIG. 7) of a door 12, 13 providing access to a doorway leading into a room inside a smoke-filled or burning structure 16. A firefighter 18, who is performing a search and rescue operation inside the burning structure 16, is carrying a thermal imaging camera 20 that is adapted to detect heat sources emitting radiation in the infrared band of the electromagnetic spectrum. The thermal imaging camera 20 permits the firefighter 18 to penetrate heavy smoke and overcome darkness to visualize infrared emitting sources inside the burning structure during the search and rescue operation. Thermal imaging cameras 20 may, for example, detect infrared radiation in the 8,000 nm to 14,000 nm range, which is significantly outside of the visible light range of 400 nm to 700 nm.

The infrared marker 10 is visible to the firefighter 18 as an image 21 in a display 22 of the thermal imaging camera 20. The presence of the infrared marker 10 on the knobs 12, 13 of the door 14 alerts the firefighter 18 that the room has searched and cleared during the search and rescue operation and, consequently, the room accessible through the door 14 does not require another search. This improves firefighter safety in that searched rooms bearing the infrared marker 10 on the door 14 are not needlessly searched multiple times, which speeds the search and rescue operation. The image 21 of the infrared marker 10 visible on the display is crescent shaped or C-shaped based on the shape of the deployed infrared marker 10, although the invention is not so limited as the marker 10 may have a different deployed imageable configuration.

Figure 2:
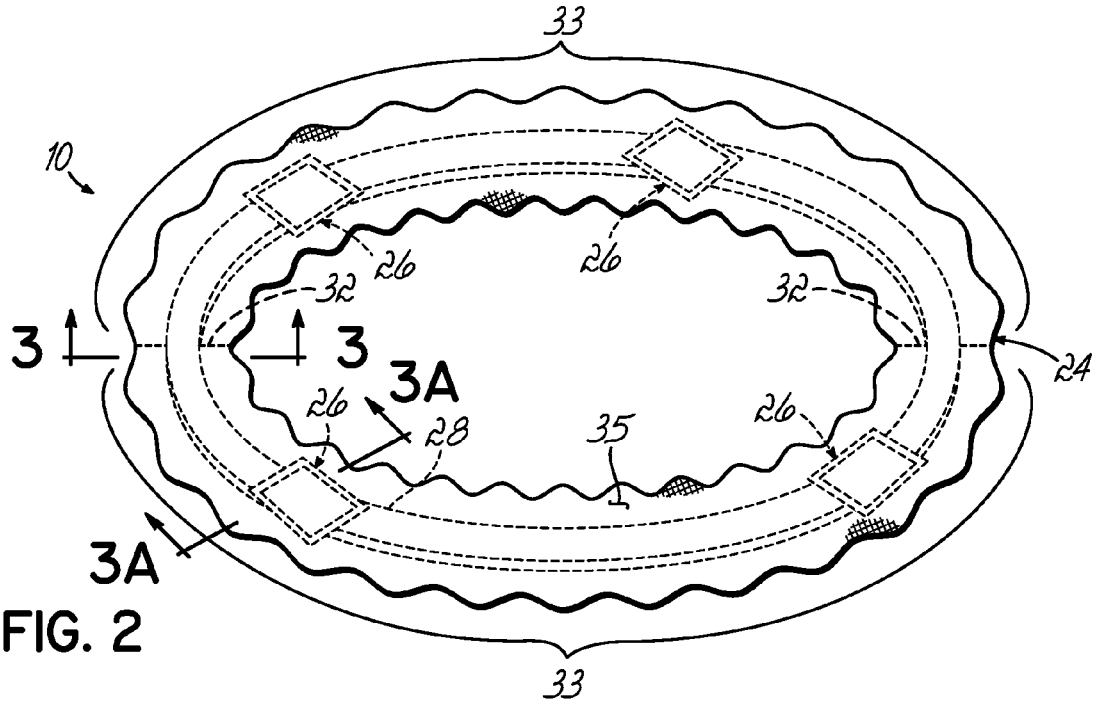
FIG. 2 is a perspective view of the infrared marker of FIG. 1 in an undeployed condition.
Figure 2A:
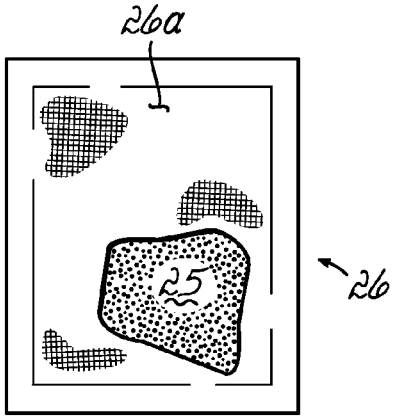
FIG. 2A is an enlarged view of a pouch containing self-heating material and disposed inside the infrared marker of FIG. 2.
Figure 3:
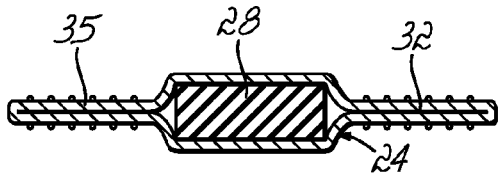
FIG. 3 is a cross-sectional view taken through a seam of the infrared marker and generally along line 3-3 in FIG. 2.
Figure 4:
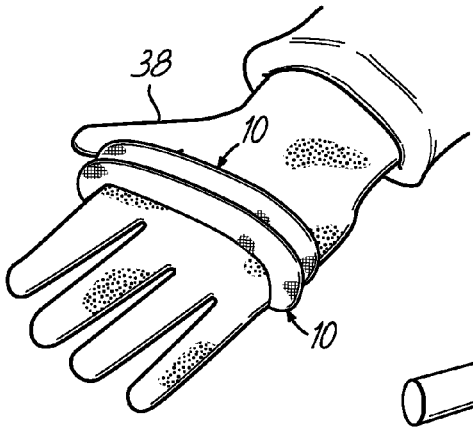
FIG. 4 is a view of the infrared marker of FIG. 2 wrapped about the gloved hand of a firefighter.

With reference to FIGS. 2-4, the infrared marker 10 comprises an outer tube or sleeve 24, an amount of an exothermic, self-heating material 25 (FIG. 2A) confined in a plurality of air-permeable packs or pouches 26 confined inside the outer sleeve 24, and an extensible elastic band 28 disposed inside the sleeve 24. Advantageously, the composition of the self-heating material 25 inside the pouches 26 may be selected such that, upon activation, the temperature of the self-heating material 25 may be approximately 135° F. to approximately 175° F. At these temperatures, the infrared marker 10 emits heat energy as infrared radiation that may be readily detectable by the thermal imaging camera 20 and displayed on display 22 with a clear contrast level relative to background objects visible to the firefighter 18. The heat or infrared signature emitted by the infrared marker 10 advantageously does not require an electrical power source for heat generation.

The composition of the self-heating material 25 in pouches 26 may include one or more chemicals and chemical compounds that oxidize to generate heat when exposed to an oxidant, such as oxygen from the air. One common variety of self-heating material 25 has a composition that generates heat based upon iron oxidation triggered by the presence of an oxidant, such as oxygen from the ambient air, inside the outer sleeve 24. Pouches 26 suitable for use in the present invention are disclosed in U.S. Pat. No. 5,918,590, which is hereby incorporated by reference herein in its entirety, as an oxygen permeable container holding a particulate exothermic composition consisting of amounts of iron powder, activated carbon, non-activated carbon, and mixtures thereof, a metal salt such as sodium chloride, and water held in a water holding material like vermiculite. Another useable composition for the self-heating material 25 may consist of iron powder, carbon, salt, and vermiculite as a water holding material or any similar oxidizing ingredients. Still other compositions for the self-heating material 25 may require the rupture of a frangible barrier to allow different chemicals to mix to initiate the exothermic chemical reaction of the infrared marker 10.

Figure 3A:
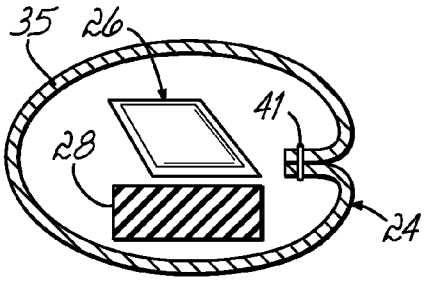
FIG. 3A is a cross-sectional view taken generally along line 3A-3A in FIG. 2.

The outer sleeve 24, which is shaped like a ring or toroid, has a tubular construction with a tubular sidewall 35 consisting of one or more layers of woven or nonwoven fabric or cloth, as best shown in FIG. 3A. The fabric constituting the tubular sidewall 35 is porous to air, which permits air to permeate the tubular sidewall 35 and enter the space inside the outer sleeve 24 in which the pouches 26 of self-heating material 25 are confined. Advantageously, the fabric or cloth of the outer sleeve 24 may be formed from threads or fibers of a flame-resistant or flame-retardant material, or may be formed from threads or fibers of a cotton or cotton blend to which a chemical treatment is applied to make the material flame-resistant or flame-retardant. Advantageously, the fabric or cloth constituting the outer sleeve 24 may be water repellant if the self-heating material 25 is negatively impacted by water exposure. Of course, self-heating materials 25 capable of initiating and sustaining the chemical reaction in the absence of oxygen may impose different requirements on the properties of the fabric or cloth in the outer sleeve 24 as understood by a person having ordinary skill in the art.

The outer sleeve 24 may be formed from a rolled length of fabric material having the free open ends and side edges sewn together, after the elastic band 28 and pouches 26 are inserted, to form seams that define the tubular sidewall 35. To that end, opposite side edges of the outer sleeve 24 may be joined together by a line of stitches 41 and the ends of the outer sleeve 24 may be joined by another set of stitches (not shown). The invention contemplates that the outer sleeve 24 may be formed from a stretchable elasticized fabric made with elastic strands, instead of the elastic insert defined by the elastic band 28 that elasticizes the outer sleeve 24.

As best shown in FIG. 2A, the pouches 26 may be stationed at spaced-apart locations distributed about the circumference of the outer sleeve 24. Each of the pouches 26 includes at least one air permeable wall 26*a* that, when the infrared marker 10 is activated, permits the passage of oxygen-containing air from the space inside the tubular sidewall 35 of the outer sleeve 24 to the self-heating material 25. The wall 26*a* of the pouch 26 may also regulate the transfer of water across its thickness for purposes of controlling the loss of water from the self-heating material 25 through the sidewall 26*a* for those self-heating materials 25 that rely on moisture during the exothermal chemical reaction.

The pouches 26 may be unattached and free to move circumferentially within the outer sleeve 24. To provide confinement, the outer sleeve 24 may include a plurality of transverse seams 32 defined by stitching that compartmentalize the outer sleeve 24 to an extent sufficient to confine each of the pouches 26 within an arc length of the circumference of the outer sleeve. In a specific embodiment, the outer sleeve 24 may include a plurality of, for example, two transverse seams 32 that define compartments 33 each holding one or more of the pouches 26 and confining circumferential movement of each individual pouch 26 within each half of the circumference. In various embodiments, there may be two (2) to six (6) transverse seams 32 compartmentalizing the outer sleeve 24.

Alternatively, the pouches 26 may be directly attached to the tubular sidewall 35 of the outer sleeve 24 and/or directly attached to the elastic band 28 so that the transverse seams 32 are not required. In other alternative embodiments of the present invention, the outer sleeve 24 may lack transverse seams 32 such the interior of the outer sleeve 24 constitutes a single continuous space in which the unattached pouches 26 are free to move. In these embodiments, the lumen defined by the outer sleeve 24 would supply an air passage for transferring heat about the entire circumference of the infrared marker 10.

Advantageously, the pouches 26 are positioned in the outer sleeve 24 at circumferential locations such that, regardless of how the infrared marker 10 is applied to the knobs 12, 13 and if the door 14 is either open or closed, the heat emission from at least one of the pouches 26 is visible in the thermal imaging camera 20 from the exterior of the door 14. The confinement of the heat emission from the pouches 26 by the outer sleeve 24 may result in heat confinement along the entire circumference of the outer sleeve 24, as opposed to discrete hot spots only at the location of the pouches 26. As a result, the entire length of the infrared marker 10 will be visible in the display 22 of the thermal imaging camera 20.

The elastic band 28, which may be formed from any suitable continuous or endless strip elastic material having a loop shape, is circumferentially disposed inside the outer sleeve 24. When relaxed, the elastic band 28 causes the outer sleeve 24 to bunch, wrinkle or shirr when the outer sleeve 24 contracts in dimension to conform to the elastic band 28. Advantageously, the length of the outer sleeve 24 and elastic band 28 are selected such that the infrared marker 10 may be easily applied by a firefighter 18 to the knobs 12, 13 of substantially all conventional doors 14 and, after application, the elastic band 28 supplies tension sufficient to keep the infrared marker 10 secured to the knobs 12, 13. One suitable material for the elastic band 28 is latex rubber, which may elongate to several times its relaxed length when stretched. Generally, the elastic band 28 may be formed from any material that, upon application of a force to its relaxed, initial length, can stretch or elongate to its elongated length without rupture and breakage, and which can substantially recover its initial length upon release of the applied force. The elastic band 28 may have any desired cross-sectional shape, such as rectangle, trapezoid, round, oval, irregular or the like, as well as any combination thereof.

Figure 5:
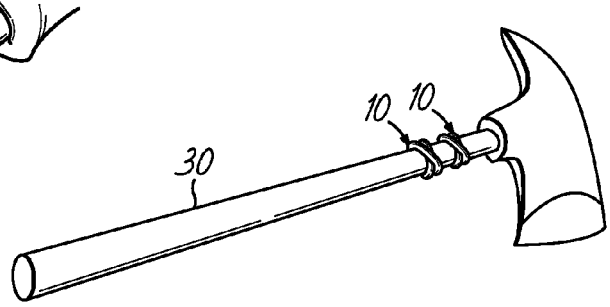
FIG. 5 is a view of the infrared marker of FIG. 2 wrapped about a tool handle.

The outer sleeve 24 has a relaxed circumference substantially determined by the circumference of the elastic band 28 and a maximum stretched circumference limited by the physical dimensions of the outer sleeve 24. In an exemplary embodiment of the present invention, the elastic band 28 of latex rubber may have a length of about twelve (12) inches and the outer sleeve 24 may have a maximum stretched circumference of about twenty-four (24) inches to thirty-six (36) inches. These lengths are specified such that the infrared marker 10 may be deployed on the door knobs 12, 13 and such that one or more of the infrared markers 10 may be carried either securely wrapped about the palm of the firefighter's gloved hand 38 (FIG. 4) or securely wrapped about the handle of a tool, such as a fire axe 30 (FIG. 5). Carrying one or more the infrared markers 10 on the fire axe 30 may advantageously permit the firefighter 18 to easily locate and grasp the fire axe 30 if the fire axe 30 is dropped during the search and rescue operation. Infrared markers 10 are carried on the firefighter's gloved hand 38 may be used to locate the firefighter 18.

Figure 6:
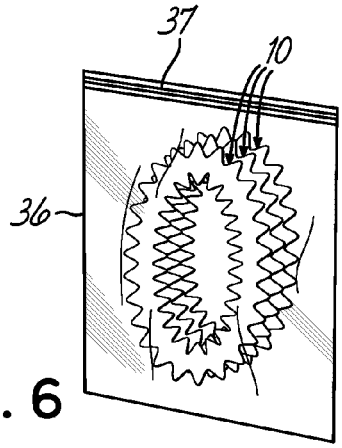
FIG. 6 is a view showing several of the infrared markers of FIG. 2 stored in a latent condition inside of an air tight enclosure.

With reference to FIG. 6, the infrared marker 10 is normally confined in a sealed bag or other sealed enclosure 36. In embodiments in which the self-heating material 25 is activated by oxygen, the sealed enclosure 36 has walls that are formed from a material that prevents oxygen from the air from reaching the self-heating material 25 confined inside the pouches 26. As a result, the infrared marker 10 is stored for use inside the sealed enclosure 36 in a latent or dormant state in a substantially oxygen deprived ambient atmosphere in which the self-heating material 25 is not generating heat. The present invention contemplates that a plurality of the infrared markers 10 may be provided inside a single sealed enclosure 36 in the form of a kit. The sealed enclosure 36 may include a resealable closure 37 or may include another type of access mechanism, such as a frangible seal.

In use and with reference to FIGS. 1-7, the firefighter 18 removes the infrared marker 10 from the sealed enclosure 36 in route to the burning structure 16 or after arriving at the site of the burning structure 16. Air permeates through the fabric or cloth of the outer sleeve 24 and through the air permeable walls of the pouches 26 to the self-heating material 25 in the pouches 26. The self-heating material 25 is exposed to oxygen in the air, which initiates a chemical reaction with the self-heating material 25 that causes heat emission from the pouches 26. The properties, including but not limited to amount, distribution, and composition, of the self-heating material 25 inside the pouches 26 are selected to provide heat emission, which provides a heat signature visible in the display 22 of the thermal imaging camera 20, that persists for several hours.

The firefighter 18 wraps one or more of the infrared markers 10 about the palm of his gloved hand 38 (FIG. 4) or about the handle of the fire axe 30 (FIG. 5) in a double-wrapped manner before entering the burning structure 16. After the firefighter 18 searches each of the rooms inside the burning structure 16, one of the infrared markers 10 is deployed on the door knobs 12, 13 of the door 14 providing access to the room. If the infrared markers 10 are carried across the firefighter's palm, a simple swiping may be used to engage a portion of the sleeve 24 with, for example, the outer knob 12 on the door's exterior face and then stretched to extend the elastic band 28 to engage, for example, the inner knob 13 on the door's interior face. The stretched elastic band 28 relaxes to a stretched state that secures the infrared marker 10 to the knobs 12, 13 of the door 14.

Figure 7:
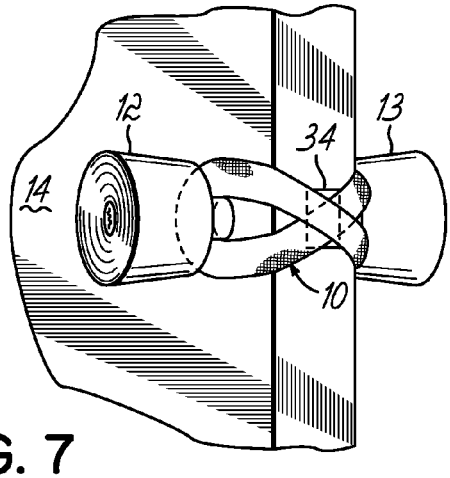
FIG. 7 is a perspective view of the infrared marker of FIG. 1 deployed in an alternative manner on the knobs of the door.
Figure 7A:
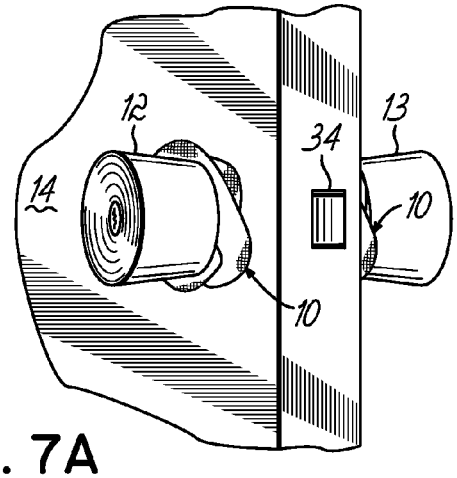
FIG. 7A is a perspective view of the infrared marker of FIG. 1 deployed in an alternative manner on the knobs of the door.

The infrared marker 10 may deployed such that a bolt 34 of a latch of the door 14 is unobstructed by the marker 10. This permits the door 14 to be closed and secured by extending the bolt 34 into a strike (not shown) in the door facing. Alternatively and as shown in FIG. 7, the infrared marker 10 may be deployed in a wrapped configuration such that the bolt 34 is occluded by a portion of the infrared marker 10 and, when the door 14 is shut, fails to latch. Alternatively and as shown in FIG. 7A, one of the infrared markers 10 may be individually wrapped about each of the door knobs 12, 13 of door 14. The invention contemplates that the infrared marker 10 may be wrapped about only the exterior door knob 12 of door 14.

The self-heating material 25 in the pouches 26 provides a heat signature in the infrared band of the electromagnetic spectrum that is visible to the firefighter 18 in the display 22 of the thermal imaging camera 20. The presence of the infrared marker 10 indicates to subsequent firefighters 18 that the room behind the door 14 has been previously searched and cleared by another firefighter 18. The infrared marker 10 is also visible in the thermal imaging camera 20 from a perspective inside the room. This may guide the firefighter in finding the door 14 through which he entered the room, if the room is dark and filled with smoke, if the firefighter becomes disoriented, or if self-contained breathing apparatus is exhausted. After use, the infrared marker 10 is left on the door 14 and eventually the chemical reaction of the self-heating material 25 goes to completion at which time heat emission ceases.

The invention contemplates that other types of objects inside a burning structure may be marked with the infrared marker 10, such as the fire axe 30. The infrared marker 10 may also be used as a locating device for the firefighter 18 when attached to the firefighter's gloved hand 38.

Figure 8:
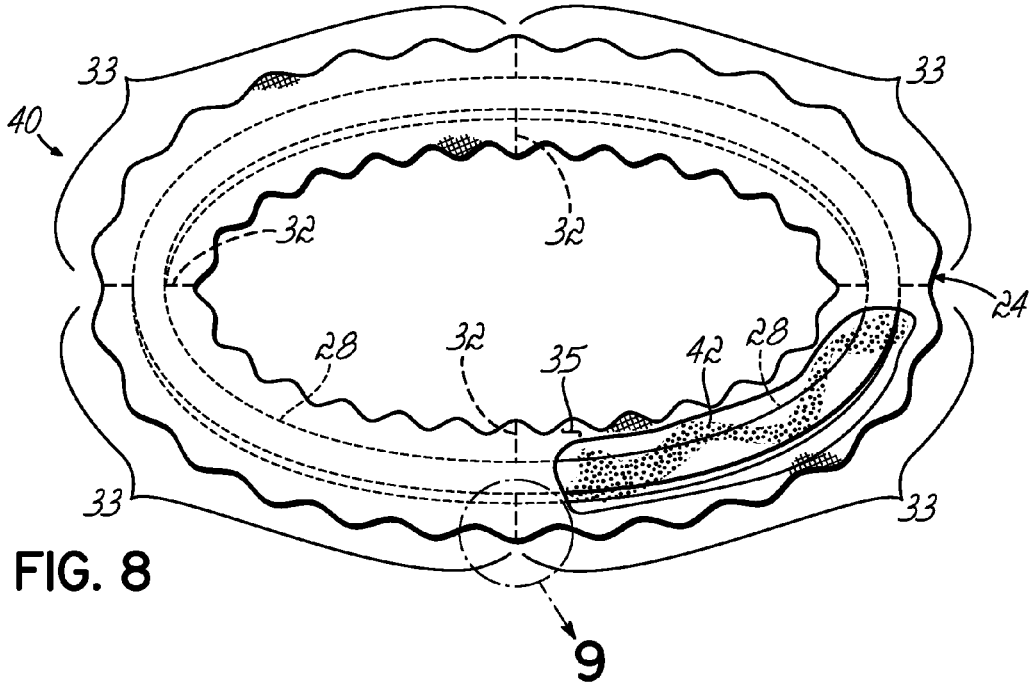
FIG. 8 is a top view of an infrared marker in accordance with an alternative embodiment of the present invention.
Figure 9:
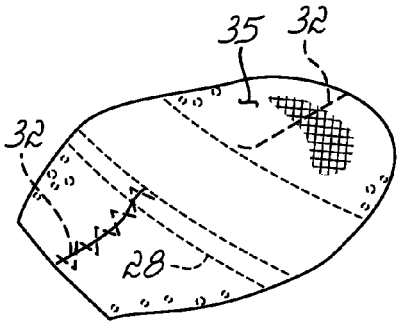
FIG. 9 is a detailed view of an encircled area of FIG. 8.
Figure 10:
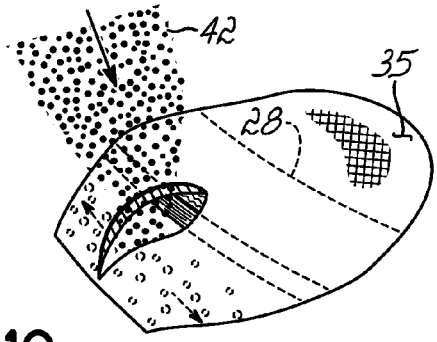
FIG. 10 is a detailed view similar to FIG. 9 illustrating an open pathway in the infrared marker for loading particulate self-heating material.

With reference to FIGS. 8-10 in which like reference numbers refer to like features in FIGS. 1-7 and in accordance with an alternative embodiment of the present invention, an infrared marking device or infrared marker 40 may include a self-heating material 42 in the form of loose particulate or powder confined inside the outer sleeve 24. The self-heating material 42 is similar or identical in composition to the self-heating material 25 confined in the pouches 26 (FIGS. 1-7). The fabric or cloth constituting the outer sleeve 24 may control the transfer of water across its thickness to prevent the entry of water into the space holding the self-heating material 42 and to regulate the loss of water through the tubular sidewall 35 for those self-heating materials 42 that rely on moisture during the exothermal chemical reaction. Therefore, the properties of the fabric or cloth are tailored to eliminate the need for pouches 26 (FIGS. 2, 2A).

Transverse seams 32 compartmentalize the outer sleeve 24 such that the self-heating material 42 does not aggregate in one location inside the outer sleeve 24. The compartmentalization is illustrated as dividing the outer sleeve 24 such that an amount of self-heated material 42 is confined within each quadrant of the circumference. During manufacture, every other transverse seam 32 is stitched closed and an opening in the outer sleeve 24 is left at the future location of every other transverse seam 32, as shown in FIG. 10, for loading the self-heating material 42 into the specific compartments 33 of the infrared marker 40. After the self-heating material 42 is introduced into the outer sleeve 24, transverse seams 32 are stitched to close the openings, as shown in FIG. 9, to define the plurality of, for example, four compartments 33 each confining an amount of the self-heating material 42. The compartmentalization serves to keep the self-heating material 42 distributed evenly about the circumference of the outer sleeve 24, although the self-heating material 42 disposed loosely within each individual compartment may aggregate to some extent.

Figure 11:
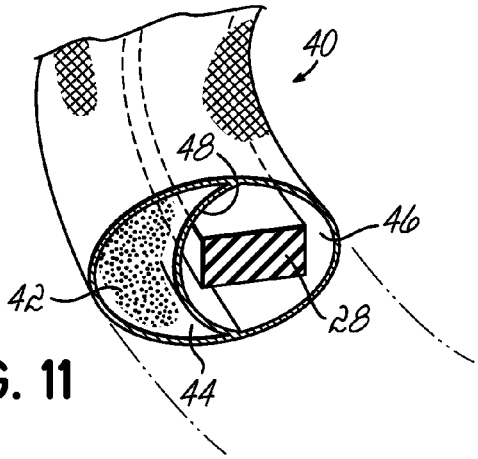
FIG. 11 is a cross-sectional view of an infrared marker in accordance with an alternative embodiment of the present invention.

With reference to FIG. 11 in which like reference numbers refer to like features in FIGS. 1-10 and in accordance with an alternative embodiment of the present invention, the outer sleeve 24 of the infrared marker 40 may also have a dual lumen configuration in which the self-heating material 42 is confined inside one circumferential lumen 44 and the elastic band 28 is disposed in the other circumferential lumen 46. The individual lumens 44, 46 are separated by a circumferential partition 48 to define a side-by-side arrangement, although the present invention is not so limited. For example, the lumens 44, 46 may have a concentric arrangement in which the elastic band 28 is placed inside the radially innermost one of the lumens 44, 46 and the self-heating powder 42 is confined in the radially outermost one of the lumens 44, 46. In this instance, at least the radially innermost of the lumens 44, 46 would supply an air passage for heat transfer about the entire circumference of the infrared marker 40 when the infrared marker 40 is activated. This may promote uniform infrared emission about the circumference of the infrared marker 40.

Figure 12:
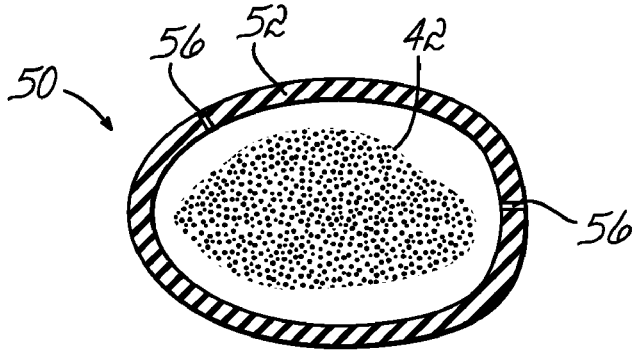
FIG. 12 is a cross-sectional view of an infrared marker in accordance with an alternative embodiment of the present invention.

With reference to FIG. 12 in which like reference numbers refer to like features in FIGS. 1-11 and in accordance with an alternative embodiment of the present invention, an infrared marker 50 may be formed from an outer sleeve 52 constructed from a material that has pores 56 that are sealed when the outer sleeve 52 is in a relaxed state. When the outer sleeve 24 is stretched for use, the pores 56 open to permit the passage of oxygen in the ambient air to the self-heating powder 42, which activates the marker 50. For clarity, the outer sleeve 52 is shown in the stretched condition in FIG. 12. so that the pores 56 are plainly visible. In this instance, the sealed enclosure 36 (FIG. 6) may be optionally required to store the infrared marker 50 in the latent or dormant oxygen-deprived state.

Figure 13:
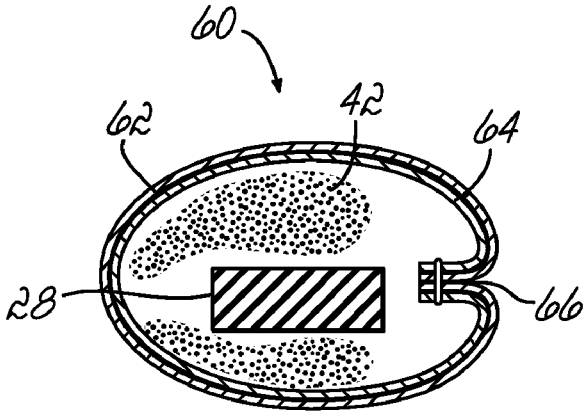
FIG. 13 is a cross-sectional view of an infrared marker in accordance with an alternative embodiment of the present invention.

With reference to FIG. 13 in which like reference numbers refer to like features in FIGS. 1-12 and in accordance with an alternative embodiment of the present invention, an infrared marker 60 may be formed from an outer sleeve 62, similar to outer sleeve 24, that is lined with a liner 64. The outer sleeve 62 and liner 64 are overlaid, rolled into a tube-shape, and joined by a longitudinal seam 66. The free open ends of the outer sleeve 62 and liner 64 are then joined together to form a ring-shaped infrared marker 60. The liner 64 may be, for example, constituted by a moisture impervious material that is pierced by pores or openings at the locations at which the stitching of the longitudinal seam 66 penetrates the liner 64. The infrared marker 60 is stored in the latent or dormant oxygen-deprived state inside the sealed enclosure 36 (FIG. 6). After removal from the sealed enclosure 36, the openings formed in the outer sleeve 62 and liner 64 by the longitudinal seam 66 permit the passage of oxygen in the ambient air to the self-heating powder 42, which activates the marker 60. In alternative embodiments, the openings in the outer sleeve 62 and liner 64 may be provided separate from, or in addition to, the openings of the longitudinal seam 66.

Figure 14:
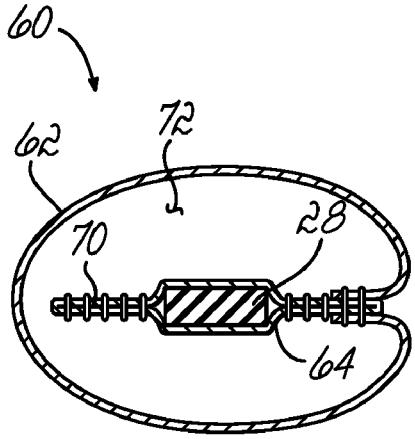
FIG. 14 is a cross-sectional view of an infrared marker in accordance with an alternative embodiment of the present invention.

With reference to FIG. 14 in which like reference numbers refer to like features in FIGS. 1-13 and in accordance with an alternative embodiment of the present invention, the liner 64 of infrared marker 60 may stitched at different circumferential locations to define transverse seams, of which transverse seam 70 is representative, that are similar to transverse seams 32 (FIGS. 2 and 8). The transverse seams 70 compartmentalize the liner 64 for confining the movement of the self-heating powder 42 (FIG. 13). Preferably, a portion of self-heating powder 42 is confined within each of the compartments (not shown) that are similar to compartments 33 (FIGS. 2 and 8). The elastic band 28 is placed inside the inner diameter of the liner 64. The outer sleeve 62 does not participate in the transverse seams 70 and, as a result, an air passage 72 is defined for heat transfer about the entire circumference of the infrared marker 60 when the infrared marker 60 is activated. This may promote uniform infrared emission about the circumference of the infrared marker 60.

The infrared markers 40, 60 are each sealed inside the air-tight enclosure 36 and used in the same manner as infrared marker 10, as described above.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the spirit or scope of applicants' general inventive concept.

What is claimed is:

1. An infrared marking device comprising:

a ring-shaped, elasticized outer sleeve having a tubular sidewall; and an amount of a self-heating material confined inside said tubular sidewall of said outer sleeve, said self-heating material emitting infrared radiation when activated to initiate an exothermic chemical reaction.

2. The infrared marking device of claim 1 wherein said sidewall of said outer sleeve is permeable to oxygen, and said self-heating material reacts exothermally when exposed to the oxygen permeating through said sidewall.

3. The infrared marking device of claim 1 further comprising:

a ring-shaped elastic band positioned inside said outer sleeve and extending circumferentially about said outer sleeve, said elastic band operating to elasticize said outer sleeve.

4. The infrared marking device of claim 3 wherein said tubular sidewall comprises a first lumen confining said elastic band and a second lumen confining said self-heating material.

5. The infrared marking device of claim 1 further comprising:

an enclosure holding said outer sleeve, said enclosure being formed from a material that prevents oxygen from reaching said self-heating material inside said outer sleeve.

6. The infrared marking device of claim 5 further comprising:

a plurality of air permeable pouches disposed inside said outer sleeve, wherein said amount of said self-heating material is distributed among said air permeable pouches and confined inside said air permeable pouches.

7. The infrared marking device of claim 6 wherein said sidewall of said outer sleeve is divided into a plurality of compartments each containing at least one of the air permeable pouches.

8. The infrared marking device of claim 1 wherein said self-heating material comprises a loose powder distributed inside said outer sleeve.

9. The infrared marking device of claim 8 wherein said sidewall of said outer sleeve is divided into a plurality of compartments, and said loose powder is distributed among said compartments.

10. The infrared marking device of claim 1 wherein said outer sleeve has a relaxed circumference of about 12 inches and a stretched circumference ranging from about 24 inches to about 36 inches.

11. The infrared marking device of claim 1 wherein said self-heating material exothermally heats to a temperature between approximately 135° F. to approximately 175° F.

12. The infrared marking device of claim 1 wherein said self-heating material exothermally heats to a temperature imageable in a thermal imaging camera.

13. A method for marking a door inside a structure, the method comprising:

activating a self-heating material confined inside a marking device to initiate an exothermic reaction that emits infrared radiation;

coupling a first portion of the marking device with a first door knob of the door.

14. The method of claim 13 further comprising:

coupling a second portion of the marking device with a second door knob so that the marking device extends between the first and second door knobs.

15. The method of claim 13 wherein activating the self-heating material further comprises:

exposing the self-heating material to oxygen to initiate the exothermic reaction that activates the self-heating material.

16. A method for marking an object inside a structure, the method comprising:

activating a self-heating material confined inside the marking device to initiate an exothermic reaction that emits infrared radiation;

wrapping a marking device about a gloved hand or a handle of an axe; and carrying the marking device into the structure.

17. The method of claim 16 wherein the object is a door, and applying the marking device further comprises:

moving the gloved hand relative to a first door knob to couple a first portion of the marking device with the first door knob; and moving the gloved hand relative to a second door knob to couple a second portion of the marking device with the second door knob so that the marking device extends between the first and second door knobs.

18. The method of claim 13 further comprising:

entering the door to search a room inside the structure before the marking device is applied to the door.

19. The method of claim 13 further comprising:

imaging a heat signature of the marking device in a thermal imaging camera.

20. The method of claim 16 further comprising:

applying the marking device to the object inside the structure.

* * * * *